US010513853B2

(12) United States Patent
Walden

(10) Patent No.: US 10,513,853 B2
(45) Date of Patent: Dec. 24, 2019

(54) ROOF COVERING AND METHOD OF APPLYING THE SAME

(71) Applicant: Owens Corning Intellectual Capital, LLC, Toledo, OH (US)

(72) Inventor: Douglas H. Walden, Newark, OH (US)

(73) Assignee: OWENS CORNING INTELLECTUAL CAPITAL, LLC, Toledo, OH (US)

( * ) Notice: Subject to any disclaimer, the term of this patent is extended or adjusted under 35 U.S.C. 154(b) by 0 days.

(21) Appl. No.: 15/468,221

(22) Filed: Mar. 24, 2017

(65) Prior Publication Data

US 2017/0275882 A1 Sep. 28, 2017

Related U.S. Application Data

(60) Provisional application No. 62/312,630, filed on Mar. 24, 2016.

(51) Int. Cl.
*E04B 1/66* (2006.01)
*E04D 13/17* (2006.01)
(Continued)

(52) U.S. Cl.
CPC ..... *E04D 13/176* (2013.01); *E04D 5/14* (2013.01); *E04D 12/002* (2013.01)

(58) Field of Classification Search
CPC ..... E04D 5/144; E04D 12/002; E04D 13/176
(Continued)

(56) References Cited

U.S. PATENT DOCUMENTS 4,974,384 A * 12/1990 Pacione ..... E04B 1/168 52/241
5,133,166 A * 7/1992 Pacione ..... E04B 1/168 52/250
(Continued)

FOREIGN PATENT DOCUMENTS

CA 2283857 8/1998
CA 2407516 11/2001
(Continued)

OTHER PUBLICATIONS

Deck Defense brochure, High Performance Roof Underlayment, Owens Corning, 4 pgs., Nov. 2013.
(Continued)

*Primary Examiner* — Gisele D Ford
(74) *Attorney, Agent, or Firm* — Calfee, Halter & Griswold LLP

(57) ABSTRACT

A roofing system includes a first group of hook fasteners, a second group of hook fasteners, and a roof covering. The first group of hook fasteners is configured to be attached to a first sloped plane of a roof, and the second group of hook fasteners is configured to be attached to a second sloped plane of the roof. The roof covering has a bottom surface, and the bottom surface of the roof covering includes a plurality of loop fasteners that are configured to engage with at least one of the first group of hook fasteners or the second group of hook fasteners. When the plurality of loop fasteners are engaged with the first group of hook fasteners, the roof covering is resisted from moving in a first direction and not resisted from moving in a second direction that is opposite the first direction. When the plurality of loop fasteners are engaged with the second group of hook fasteners, the roof covering is resisted from moving in the second direction and not resisted from moving in the first direction.

20 Claims, 8 Drawing Sheets

(51) Int. Cl.
*E04D 12/00* (2006.01)
*E04D 5/14* (2006.01)

(58) Field of Classification Search
USPC ..... 52/DIG. 13
See application file for complete search history.

(56) References Cited

U.S. PATENT DOCUMENTS 5,142,837 A * 9/1992 Simpson ..... B32B 15/08 428/141
5,723,195 A * 3/1998 Pacione ..... A47G 27/0437 156/293
6,395,362 B1 * 5/2002 Pacione ..... A47G 27/0293 428/100
6,460,303 B1 * 10/2002 Pacione ..... A47G 27/025 428/100
7,219,476 B2 5/2007 Akins et al.
8,505,249 B2 * 8/2013 Geary ..... E04D 11/00 126/622
8,915,030 B2 * 12/2014 Boven ..... H01L 31/0481 136/244
9,752,326 B2 * 9/2017 Kraus, Jr. ..... E04D 5/144
2002/0170254 A1 * 11/2002 Ritland ..... B32B 25/14 52/408
2003/0070391 A1 * 4/2003 Tachauer ..... A44B 18/0049 52/745.21
2009/0025316 A1 * 1/2009 Coulton ..... E04D 13/176 52/199
2013/0000237 A1 * 1/2013 Kraus, Jr. ..... B29C 39/18 52/410

FOREIGN PATENT DOCUMENTS

| | | |
|---|---|---|
| DE | 2263375 | 7/1974 |
| DE | 4100902 | 8/1991 |
| DE | 102009017486 | 10/2010 |
| EP | 2793809 | 10/2014 |
| WO | 98/36139 | 8/1998 |
| WO | 01/081771 | 11/2001 |

OTHER PUBLICATIONS

Deck Defense High Performance Roof Underlayment, Installation Instructions, 2 pgs., Mar. 2012.
Roofing Underlayment Types by Nick Gromicko and Kenton Shepard, 9 pages, printed on Mar. 20, 2015 from http://www.nachi.org/underlayment.

* cited by examiner

ROOF COVERING AND METHOD OF APPLYING THE SAME

RELATED APPLICATIONS

The present application claims the benefit of U.S. Provisional Application Ser. No. 62/312,630, filed on Mar. 24, 2016, titled ROOF COVERING AND METHOD OF APPLYING THE SAME, the disclosure of which is incorporated herein by reference in its entirety.

FIELD OF THE INVENTION

The present application generally relates to roof coverings and, more particularly, to a roof coverings with touch fasteners.

BACKGROUND OF THE INVENTION

In a typical roofing installation, an underlayment is applied between the roof deck and the exterior roof covering (e.g. asphalt shingles). The underlayment separates the shingles from the roof deck and provides a secondary water shedding barrier and weather protection for the roof. Traditionally, the underlayment is an asphalt impregnated felt or paper product, though now, many roof installers are using synthetic polymer underlayment sheets.

Whether asphalt impregnated paper or synthetic polymer underlayment, the underlayment sheets are typically sold in a roll to the roof installer. The standard width of the roll of underlayment is 48 inches. When installed, rows of underlayment are laid parallel to the eaves. The installer unrolls the underlayment on a roof, cuts it to the proper length, such as the width of the roof, and secures the underlayment to the roof utilizing staples or nails. Each subsequent course of underlayment is lapped over the underlaying course and secured to the roof deck and so on until the roof deck is covered. On roofs with intersecting sloped roof planes, each sloped plane is covered in a similar fashion.

SUMMARY

The present application discloses roofing systems and roofing assemblies including a roof covering, and a method of attaching a roof covering.

An exemplary roofing system includes a first group of hook fasteners, a second group of hook fasteners, and a roof covering. The first group of hook fasteners is configured to be attached to a first sloped plane of a roof, and the second group of hook fasteners is configured to be attached to a second sloped plane of the roof. The roof covering has a bottom surface, and the bottom surface of the roof covering includes a plurality of loop fasteners that are configured to engage with at least one of the first group of hook fasteners or the second group of hook fasteners. When the plurality of loop fasteners are engaged with the first group of hook fasteners, the roof covering is resisted from moving in a first direction and not resisted from moving in a second direction that is opposite the first direction. When the plurality of loop fasteners are engaged with the second group of hook fasteners, the roof covering is resisted from moving in the second direction and not resisted from moving in the first direction.

An exemplary roof assembly includes a first sloped roof plane, a second sloped roof plane, a first group of hook fasteners, a second group of hook fasteners, and a roof covering. The first sloped roof plane has a lower end and an upper end. The second sloped roof plane is transverse to the first sloped roof plane, and the second sloped roof plane has a lower end and an upper end. The upper end of the first sloped roof plane and the upper end of the second sloped roof plane form a ridge. The first group of hook fasteners are attached to the first sloped roof plane, and the second group of hook fasteners are attached to the second sloped roof plane. The roof covering is extendable from the lower end of the first sloped roof plane to the lower end of the second sloped roof plane, and the roof covering has a bottom surface that includes a group of loop fasteners. The first group of hook fasteners and the group of loop fasteners cooperate to resist movement of the roof covering relative to the sloped plane in an up slope direction while allowing movement of the roof covering relative to the first sloped roof plane in a down slope direction. The second group of hook fasteners and the group of loop fasteners cooperate to resist movement of the roof covering relative to the second sloped roof plane in an up slope direction while allowing movement of the roof covering relative to the second sloped roof plane in a down slope direction.

An exemplary method of installing a roof covering on a roof includes covering a portion of a first sloped roof plane with a first group of hook fasteners and covering a portion of the second sloped roof plane with a second group of hook fasteners. Subsequently, the method includes covering the first sloped roof plane and the second sloped roof plane with a roof covering having loop fasteners. Then, the method involves providing a force in the down slope direction to the portion of the roof covering on the first sloped roof plane to pull the portion of the roof covering on the first sloped roof plane taut, and providing a force in the down slope direction to the portion of the roof covering on the second sloped roof plane to pull the portion of the roof covering on the second sloped roof plane taut.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

BRIEF DESCRIPTION OF THE DRAWINGS

The accompanying drawings, which are incorporated in and constitute a part of this specification, illustrate some embodiments disclosed herein, and together with the description, serve to explain principles of the embodiments disclosed herein.

DETAILED DESCRIPTION OF THE INVENTION

The concepts disclosed herein will now be described by reference to some more detailed embodiments, in view of the accompanying drawings. These concepts may, however, be embodied in different forms and should not be construed as limited to the embodiments set forth herein. Rather, these embodiments are provided so that this disclosure will be thorough and complete, and will fully convey the scope of the inventions to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

As used in the description of the invention and the appended claims, the terms "top", "bottom", "upper", and "lower", when used regarding the ridge vent, roofing material, or the roof, are in reference to the ridge vent and roofing material when installed on a roof or the roof relative to the building structure. "Bottom" referring to the portion facing towards the roof or building and "top" referring to the portion facing away from the roof or building.

The embodiments of the present application describe an underlayment material used for roofing. The underlayment described in the present invention may be made of layers of polymeric sheets, non-woven polymeric materials, woven polymeric materials, fiberglass materials, asphalt, polymer modified asphalt, asphalt blended with rubber and/or plastic materials, granules, or the like. Additionally, the underlayment may be resistant to water. While the exemplary embodiments of the present application describe an underlayment configured to be installed on a roof, it should be understood that the inventive concepts described herein can be utilized on any roof covering, such as, for example, shingles, rolled roofing material that forms the outer surface of a finished roof, or the like.

Figure 1:
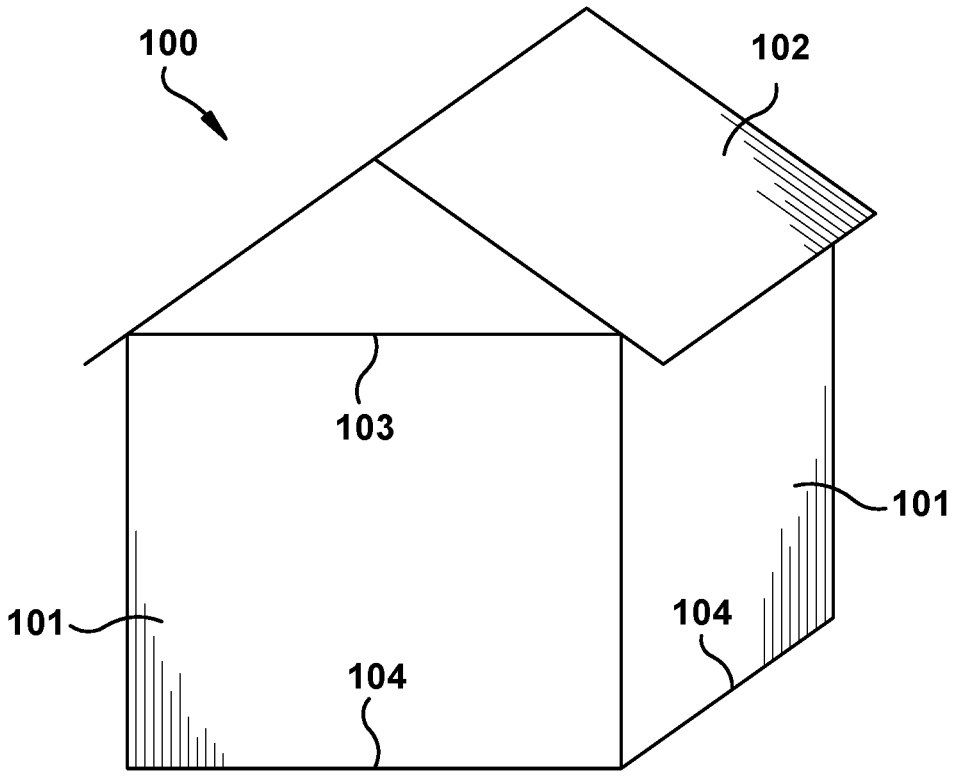
FIG. 1 is a perspective view of a building having a roof.

FIG. 1 illustrates an exemplary embodiment of a building 100 having a roof 102. The building 100 includes side walls 101. Each side wall 101 includes a top end 103 and a bottom end 104. In the illustrated embodiment in FIG. 1, the bottom end 104 of each side wall 101 is adjacent to a base surface, such as for example, the ground. The roof 102 is connected to the top ends 103 of one or more of the sidewalls 101. The sidewalls 101 and the roof 102 separate the interior areas of the building 100 from areas exterior to the building 100, as well as provide a structural, protective and aesthetically pleasing covering to the sides and top of the building 100. The side walls 101 may be covered by or support a variety of construction materials or other elements, such as, for example, interior and exterior sheathing fascia boards, gutters, a drip edge or gutter apron, or other items.

Figure 2:
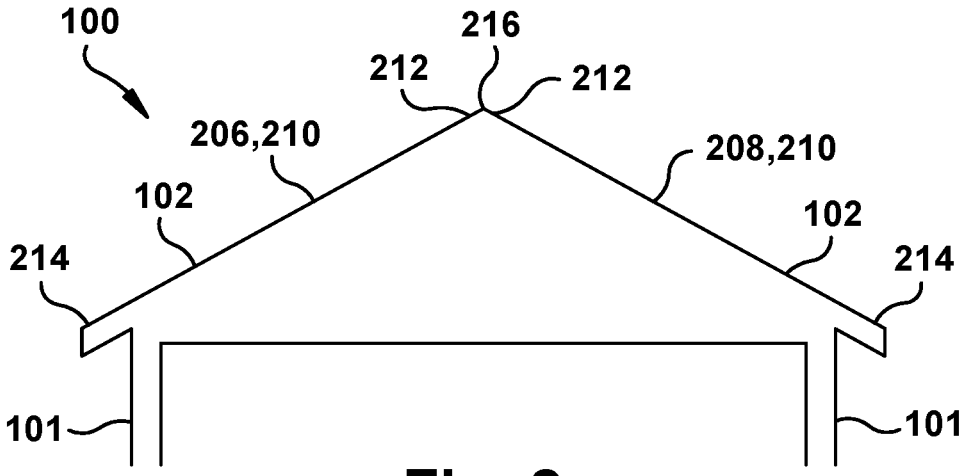
FIG. 2 is a front partial view of the building having a roof of FIG. 1.

FIG. 2 is a partial front view of the exemplary building 100 of FIG. 1 including a roof 102. The roof 102 includes a first sloped roof plane 206 and a second sloped roof plane 208. In one embodiment, the roof planes 206, 208 may be made of a wood-based material. In certain embodiments, the roof planes are formed from panel-based materials, such as oriented strand board (OSB). In other embodiments, the roof planes may be made of other materials, such as for example, plywood. Each sloped roof plane 206, 208 has a top surface 210, an upper end 212, and a bottom end 214. The upper end 212 of the first sloped roof plane 206 and the upper end 212 of the second sloped roof plane 208 form a ridge 216.

Figure 3:
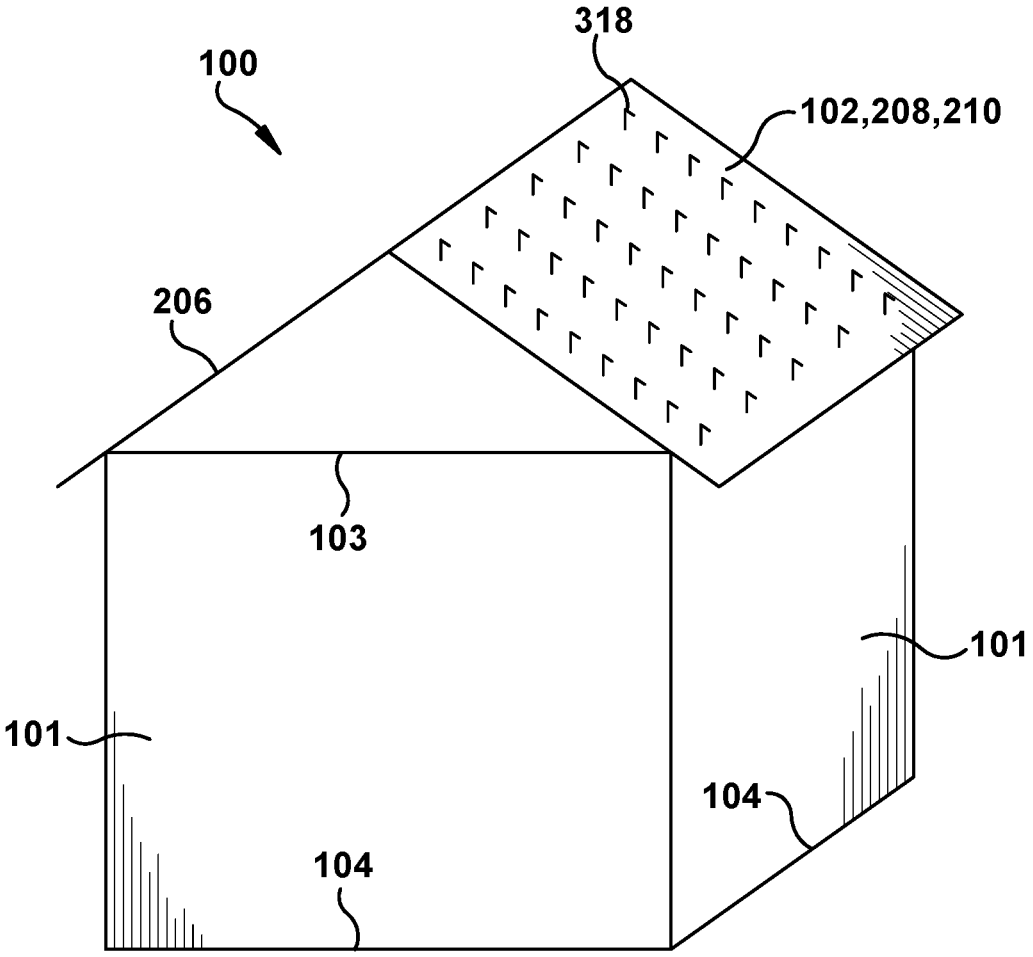
FIG. 3 is a perspective view of a building having a roof with an exemplary embodiment of hook fasteners disposed on the roof.

FIG. 3 is a perspective view of the building 100 having the roof 102 of FIG. 2 with an exemplary embodiment of hook fasteners 318 disposed on the roof. In the illustrated embodiment, the hook fasteners 318 include a plurality of unidirectional, loop-engageable fastener elements attached to the top surface 210 of the first sloped roof plane 206 and to the top surface 210 of the second sloped roof plane 208. The hook fasteners 318 may be configured in a variety of ways and may be attached to the roof 102 in a variety of ways. In the exemplary embodiment, each of hook fasteners 318 include a stem portion extending outward from a base and a hook portion at a terminal end opposite the base portion. The hook portion faces in a single direction such that the hook fasteners 318 are unidirectional hooks. In an exemplary embodiment, the hook portion of the hook fasteners 318 on the first sloped plane face 206 face the bottom end 214 of the first sloped plane 206, and the hook portion of the hook fasteners 318 on the second sloped plane 208 face the bottom end 214 of the second sloped plane 208. In one exemplary embodiment, the base, the stem portion, and the hook portion of the hook fasteners 318 are formed as a single piece of molded polymer, such as, for example, polyamide, polyester, polypropylene, polyethylene, and vinyl.

The hook fasteners 318 may be attached to the roof 102 in such a manner and configuration as to secure an underlayment 400 (FIGS. 4A and 4B) to the roof 102. The hook fasteners 318 may be attached to the roof 102 by any suitable means, such as, for example, an adhesive and/or fasteners, such as staples or nails. In an exemplary embodiment, the bottom surface of the base includes an adhesive.

The base of the hook fasteners 318 may be shaped in a variety of ways and may be placed on the roof 102 in a variety of locations. For example, the base may be strips, ovals, coin-shaped, squares, or any other suitable shapes. The number of hook fasteners 318 attached to the roof 102 may vary. The density of the hook fasteners 318 on the base may vary. In certain embodiments, the hook fasteners 318 are disposed on between about 25% and about 75% of the top surface 212 of each sloped roof plane 206, 208, such as between about 30% and about 70%, such as between about 40% and about 60%, and such as about 50%. In another embodiment, the hook fasteners 318 are disposed on less than about 75% of the top surface 212 of each sloped roof plane 206, 208, such as less than about 70%, such as less than about 60%, such as less than about 50%, such as less than about 40%, such as less than about 30%, and such as less than about 25%. Additionally, the hook fasteners 318 may be arranged in horizontal and/or vertical strips on the sloped roof planes 206, 208.

Figure 4A:
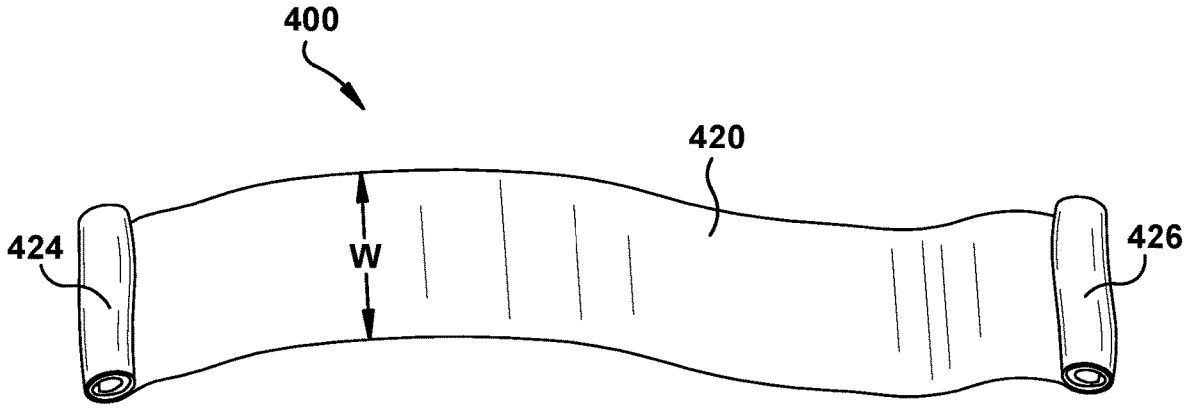
FIG. 4A is a top view of a roll of underlayment.
Figure 4B:
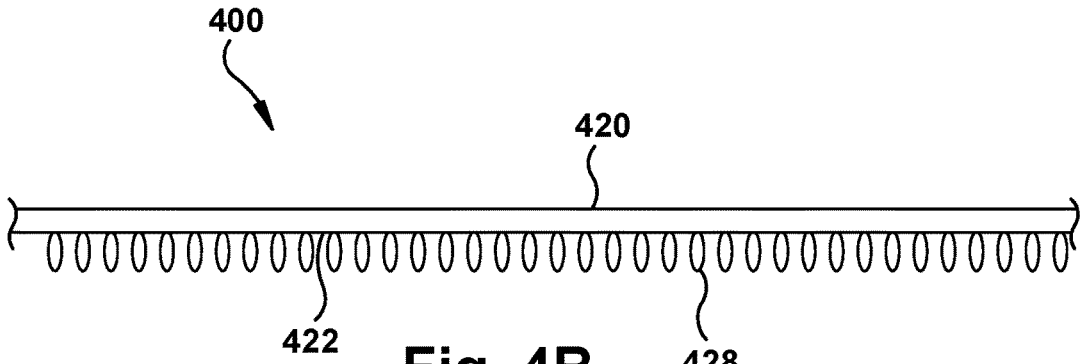
FIG. 4B is a side view of an exemplary embodiment of underlayment with loop fasteners disposed on the bottom of the underlayment.

FIGS. 4A and 4B illustrate a roll of underlayment 400. The underlayment 400 has a top surface 420 configured to face away from the roof 102 and a bottom surface 422 configured to face toward from the roof 102. The top surface 420 may include an adhesive, such as, for example, an asphalt adhesive, or other type of adhesives for securing an overlying roofing material, such as a shingle. The underlayment 400 may be configured in a variety of ways. For example, the underlayment 400 may be a sheet having one or more layers and may be formed from one or more materials. Any suitable underlayment material(s) may be used, such as, for example, polymer based, waterproof, asphalt based, or any other type of known underlayment material. In the exemplary embodiment, the underlayment 400 is a sheet that may be arranged in a roll for shipping and storage. Referring to the exemplary embodiment provided in FIG. 4A, the underlayment 400 may optionally take the form of a scroll with a first scroll portion 424 and a second scroll portion 426. In this embodiment, the first scroll portion 424 is configured to cover one sloped roof plane, and the second scroll portion 426 is configured to cover an adjacent sloped roof plane. Referring to FIG. 4B, the underlayment 400 includes a plurality of loop fasteners 428 attached to the bottom surface 422. The loop fasteners 428 are configured to engage and attach with hook fasteners 318 disposed on a roof 102. The loop fasteners 428 may be made of, for example, a plastic material, an open mesh material, or any material that is known to be used in hook and loop type connections. In certain embodiments, the width W of the underlayment may be in the range of about 24 inches to the width of the roof 102. When the width of the underlayment 400 is less than the width of the roof 102, strips of the underlayment 400 may be overlapped and/or sealed together to cover the entire width of the roof 102.

The length of the underlayment 400 may vary at different stages of installation. For example, when in a scroll (or roll) format, the length of the underlayment may be as long as practical for storing, shipping, and moving the scroll (or roll) of underlayment 400. When ready for installation, the underlayment may be cut to an installation length. The installation length may vary depending on the specific roof 102 being covered. Factors such as the length and the slope of the roof, the height of the building 100, the method of installation, and other relevant factors may dictate the installation length. In certain embodiments, the underlayment 400 may be a single unitary piece that extends from the lower edge 214 of the first sloped roof plane 206 to the lower edge 214 of the second sloped roof plane 208. In one embodiment, the underlayment 400 is installed on the sloped roof planes 206, 208 and cut to an final length, such that the underlayment 400 extends from the lower edge 214 of the first sloped roof plane 206 to the lower edge 214 of the second sloped roof plane 208 (e.g. eave to eave). In another embodiment, the underlayment 400 may be manufactured to a length that corresponds to the dimensions of a roof, which reduces the labor costs of installing the underlayment 400.

Figure 5A:
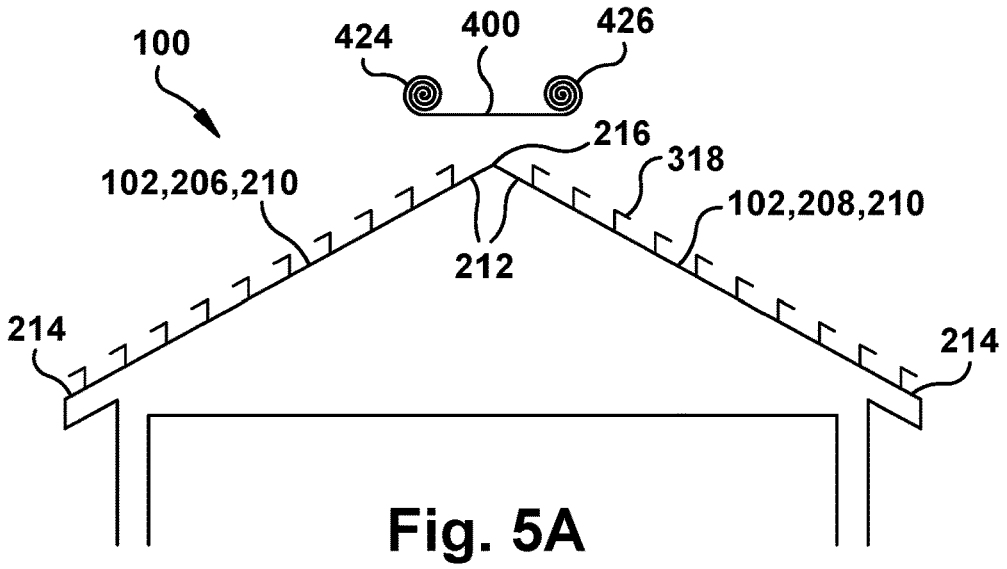
FIG. 5A is a front view of the roof of FIG. 2 with hook fasteners disposed on the roof with an exemplary underlayment prior to attachment.
Figure 5B:
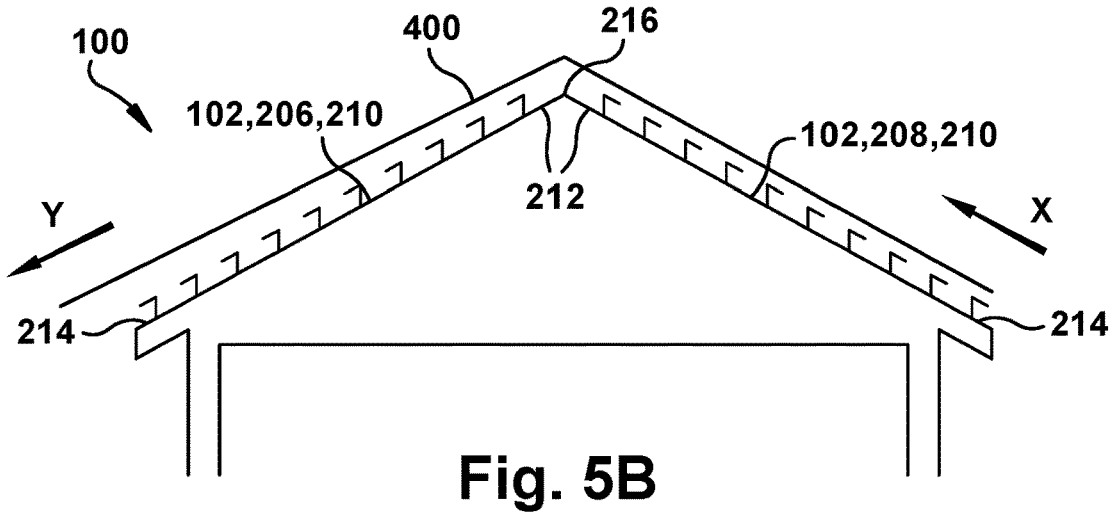
FIG. 5B is a front view of the roof of FIG. 2 with hook fasteners disposed on the roof with the exemplary underlayment being supported from one side of the roof.
Figure 5C:
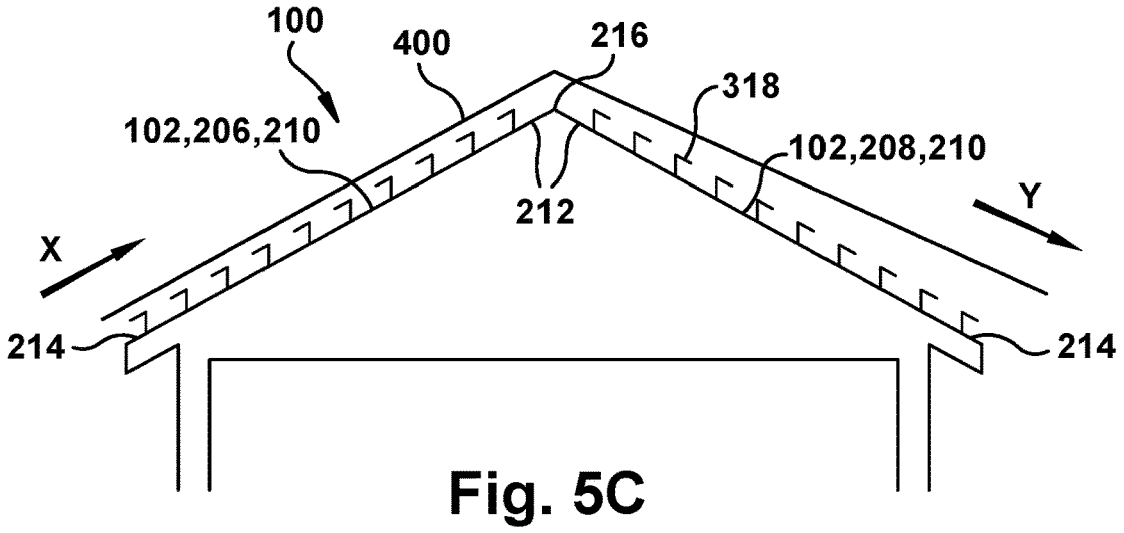
FIG. 5C is a front view of the roof of FIG. 2 with hook fasteners disposed on the roof with the exemplary underlayment being supported from the other side of the roof.

FIG. 5A-5C illustrate a roof 102 with hook fasteners 318 disposed on the roof 102 and underlayment 400 in various positions for being attached to the roof 102. The first sloped surface 206 and second sloped surface 208 each have a plurality of hook fasteners 318 disposed on their top surfaces 210. In certain embodiments, the hook fasteners 318 may be unidirectional hooks, such that the hook fasteners 318 provide resistance in only one direction. In the illustrated embodiment, the hook fasteners 318 on the first sloped plane face 206 face the bottom end 214 of the first sloped plane 206, and the hook fasteners 318 on the second sloped plane 208 face the bottom end 214 of the second sloped plane 208. Therefore, in this embodiment, the hook fasteners 318 provide resistance to pulling or otherwise moving the underlayment toward the upper end 212 of each roof plane 206, 208 and no resistance, or little resistance, to pulling or otherwise moving the underlayment toward the bottom end 214 of each roof plane.

Referring to FIG. 5A, the underlayment 400 may take the form of a scroll with a first scroll portion 424 and a second scroll portion 426. The first scroll portion 424 is configured to cover the first sloped plane 206, and the second scroll portion 426 is configured to cover the second sloped plane 208. The scrolled underlayment 400 is positioned at the ridge 216 of the roof 102. The first scroll portion 424 is unrolled down the first sloped roof plane 206, and the second scroll portion 426 is unrolled down the second sloped roof plane 208. The first and second scroll portions 424, 426 may unroll down the sloped roof planes 206, 208 by gravity, for example.

Referring to FIG. 5B, the installation length of the underlayment 400 for the first sloped roof plane 206 is such that the underlayment 400, when unrolled, extends past the lower edge 214 of the roof 102. The underlayment 400 is prohibited from moving in the direction X because the loop fasteners 428 on the bottom surface 422 of the underlayment 400 are engaged with the hook fasteners 318 on the second sloped roof plane 208. A force is then applied to the underlayment 400 in a down slope direction Y over the first sloped roof plane 206. The hook fasteners 318 and the loop fasteners 428 do not prevent movement of the underlayment 400 in the down slope direction Y. Thus, the portion of the underlayment 400 over the first sloped roof plane 206 is drawn taut as the portion of the underlayment 400 over the second sloped roof plane 208 is held firm. Additionally, because movement of the underlayment 400 is not prohibited in the down slope direction Y, the underlayment 400 is easy to reposition, straighten, and make smooth after being installed on the roof 102.

Referring to FIG. 5C, the installation length of the underlayment 400 for the second sloped roof plane 208 is such that the underlayment 400, when unrolled, extends past the lower edge 214 of the roof 102. The underlayment 400 is prohibited from moving in the direction X because the loop fasteners 428 on the bottom surface 422 of the underlayment 400 are engaged with the hook fasteners 318 on the first sloped roof plane 206. A force is then applied to the underlayment 400 in a down slope direction Y over the second sloped roof plane 208. The hook fasteners 318 and the loop fasteners 428 do not prevent movement of the underlayment 400 in the down slope direction Y. Thus, the portion of the underlayment 400 over the second sloped roof plane 208 is drawn taut as the portion of the underlayment 400 over the first sloped roof plane 206 is held firm. Additionally, because movement of the underlayment 400 is not prohibited in the down slope direction Y, the underlayment 400 is easy to reposition, straighten, and make smooth after being installed on the roof 102.

Once installed and drawn taut, the hook fasteners 318 and the loop fasteners 428 will secure the underlayment 400 to the roof 102. When the top surface 420 of the underlayment 400 includes an adhesive for securing an outlying roofing material, such as shingles, the roofing can be installed without any fasteners penetrating the underlayment or overlying roofing material (i.e., shingles). As such, a roofing system with no potential leak paths is constructed.

In another exemplary embodiment, the loop fasteners 428 may be disposed on the top surface 210 of the roof 102, instead of the hook fasteners 318, and the unidirectional hook fasteners 318 may be disposed on the bottom surface 424 of the underlayment 400 in a manner that would provide resistance to the underlayment 400 toward the ridge 216 of the roof 102 and provide no or reduced resistance to the underlayment 400 toward the bottom ends 214 of each sloped roof plane 206, 208.

In another exemplary embodiment, the underlayment 400 may be applied to each sloped roof plane 206, 208 separately. Specifically, the underlayment 400 may be in the form of a roll. In this embodiment, the underlayment 400 may be attached to the upper end 212 of the first sloped roof plane 206 by, for example, an adhesive, a fastener, such as a nail, or the like. The first sloped roof plane 206 includes a plurality of hook fasteners 318, and the bottom surface 422 of the underlayment 400 includes a plurality of loop fasteners 428, such that when the loop fasteners 428 engage the hook fasteners 318, the underlayment 400 is prohibited from moving in the up slope direction, but not prohibited from moving in the down slope direction. Once the underlayment 400 is attached to the upper end of the first sloped roof plane 206, a force is applied to the underlayment 400 in the down slope direction to draw the underlayment 400 taut over the first sloped roof plane 206. Similarly, in this embodiment, the underlayment 400 may be attached to the upper end 212 of the second sloped roof plane 208 by, for example, an adhesive, a fastener, such as a nail, or the like. The second sloped roof plane 208 includes a plurality of hook fasteners 318, and the bottom surface 422 of the underlayment 400 includes a plurality of loop fasteners 428, such that when the loop fasteners 428 engage the hook fasteners 318, the underlayment 400 is prohibited from moving in the up slope direction, but not prohibited from moving in the down slope direction. Once the underlayment 400 is attached to the upper end of the second sloped roof plane 206, a force is applied to the underlayment 400 in the down slope direction to draw the underlayment 400 taut over the second sloped roof plane 206.

Figure 6:
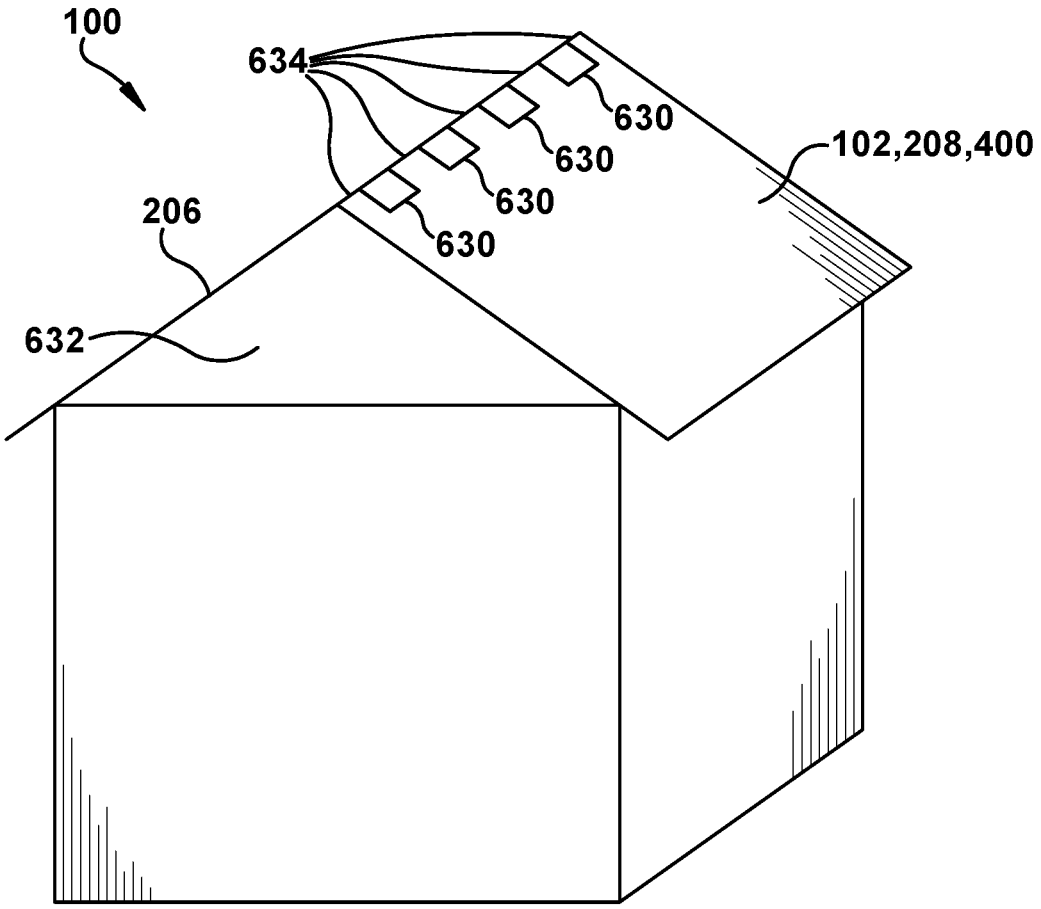
FIG. 6 is a perspective view of a building with an exemplary underlayment including openings for vents.

FIG. 6 is a perspective view of a building 100 having openings 630 for vents. In certain embodiments, an attic space 632 is located under the roof 102, which requires proper venting. It is customary for the ridge 216 of the roof 102 to be vented. To facilitate venting the attic 632, openings 630 may be formed in the underlayment 400 along the ridge 216. The openings 630 may be formed in a variety of ways. Any opening 630 in the underlayment 400 which allows for an air flow path through the underlayment 400 may be used. In certain embodiments, the openings 630 are marked by print cutouts in the underlayment 400 that indicate where and how to cut openings 630 for the vents. The underlayment 400 may include at least one continuous strap 634 that connects the underlayment 400 over the first sloped roof plane 206 to the underlayment 400 over the second sloped roof plane 208. The continuous straps 634 allow the hook fasteners 318 from the first sloped roof plane 206 to support the underlayment 400 on the second sloped roof plane 208, and vice versa. In an alternate embodiment, the two separate sides of the underlayment 400 may each be secured to the roof 102 at or near the openings 630 at the ridge 216 of the roof 102.

Figure 6A:
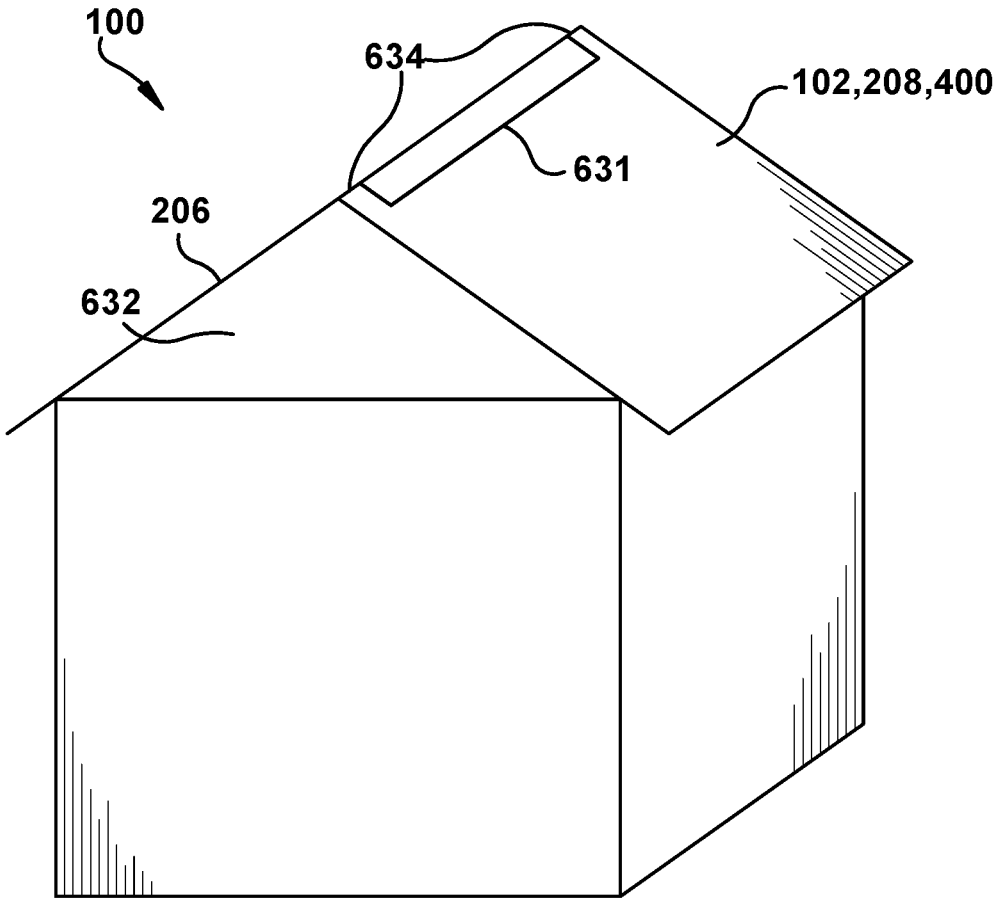
FIG. 6A is a perspective view of a building with an exemplary underlayment including a ridge slot for a ridge vent.

FIG. 6A is a perspective view of a building 100 having a ridge slot 631 for a ridge vent. In certain embodiments, an attic space 632 is located under the roof 102, which requires proper venting. It is customary for the ridge 216 of the roof 102 to be vented. To facilitate venting the attic 632, a ridge slot 631 may be formed in the underlayment 400 along the ridge 216. In certain embodiments, the ridge slot 631 is marked by print cutouts in the underlayment 400 that indicate where and how to cut ridge slot 631 for the vent. The underlayment 400 may include at least one continuous strap 634 that connects the underlayment 400 over the first sloped roof plane 206 to the underlayment 400 over the second sloped roof plane 208. The continuous straps 634 allow the hook fasteners 318 from the first sloped roof plane 206 to support the underlayment 400 on the second sloped roof plane 208, and vice versa. In an alternate embodiment, the two separate sides of the underlayment 400 may each be secured to the roof 102 at or near the ridge slot 631 at the ridge 216 of the roof 102.

Figure 7:
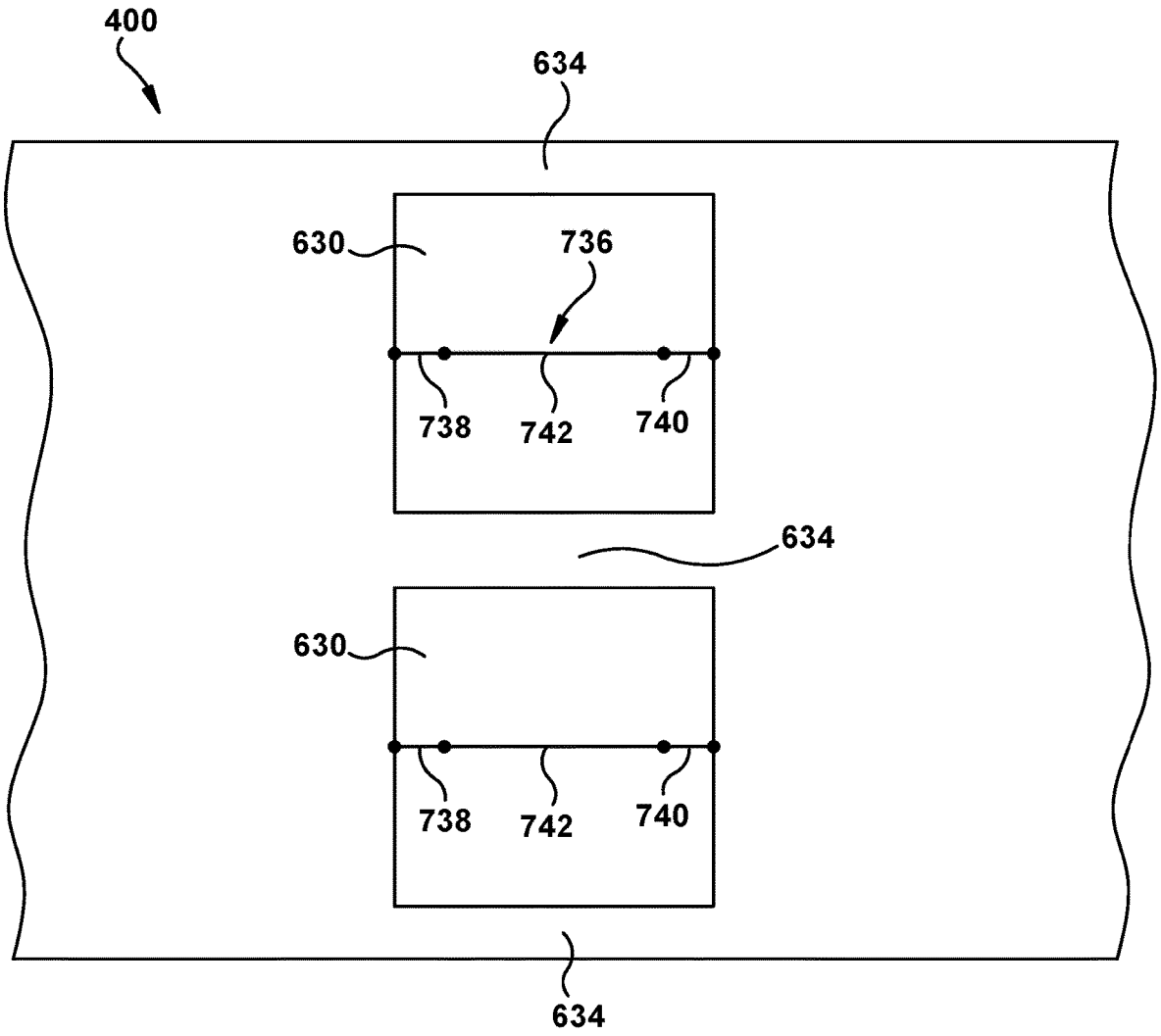
FIG. 7 is a partial view of the exemplary underlayment including the openings for vents of FIG. 6.

FIG. 7 is a partial view of the exemplary underlayment 400 including the openings 630 (or elongated ridge slot 631) for vents provided in FIG. 6 (or FIG. 6A). The openings 630 are configured to align with vents on the ridge 216 of a roof 102. The openings 630 may be any shape that conforms with the vents. In certain embodiments, the underlayment 400 includes a tensioner 736. The tensioner 736 creates a permanent force to pull the underlayment 400 in the direction of the ridge 216. In certain embodiments, the force created by the tensioner 736 to pull the underlayment 400 in the direction of the ridge is less than about 25 lb/ft, such as less than about 20 lb/ft, such as less than about 15 lb/ft, such as less than about 10 lb/ft, such as less than about 5 lb/ft, such as less than about 3 lb/ft, and such as less than about 1 lb/ft.

In the illustrated embodiment, the tensioner 736 includes a first end 738, a second end 740, and an elastic member 742. The first end 738 attaches to the part of the underlayment 400 that extends over the first sloped roof plane 206, the second end 740 attaches to the part of the underlayment that extends over the second sloped roof plane 208, and the elastic member 742 attaches the first end 738 and the second end 740. In certain embodiments, the first end 738 of the tensioner 736 is adjacent to an opening 630, and the second end 740 of the tensioner 736 is adjacent to the opening 630. The elastic member 742 biases the first end 738 and the second end 740 towards each other. In some embodiments, the member that connects the first end 738 and the second end 740 may be a fixed length strap or cord (instead of an elastic member). In other embodiments, the tensioner 736 may include clips, alligator clips, springs, a member that engages the hook fasteners 318 or loop fasteners 428, or the like.

Figure 8:
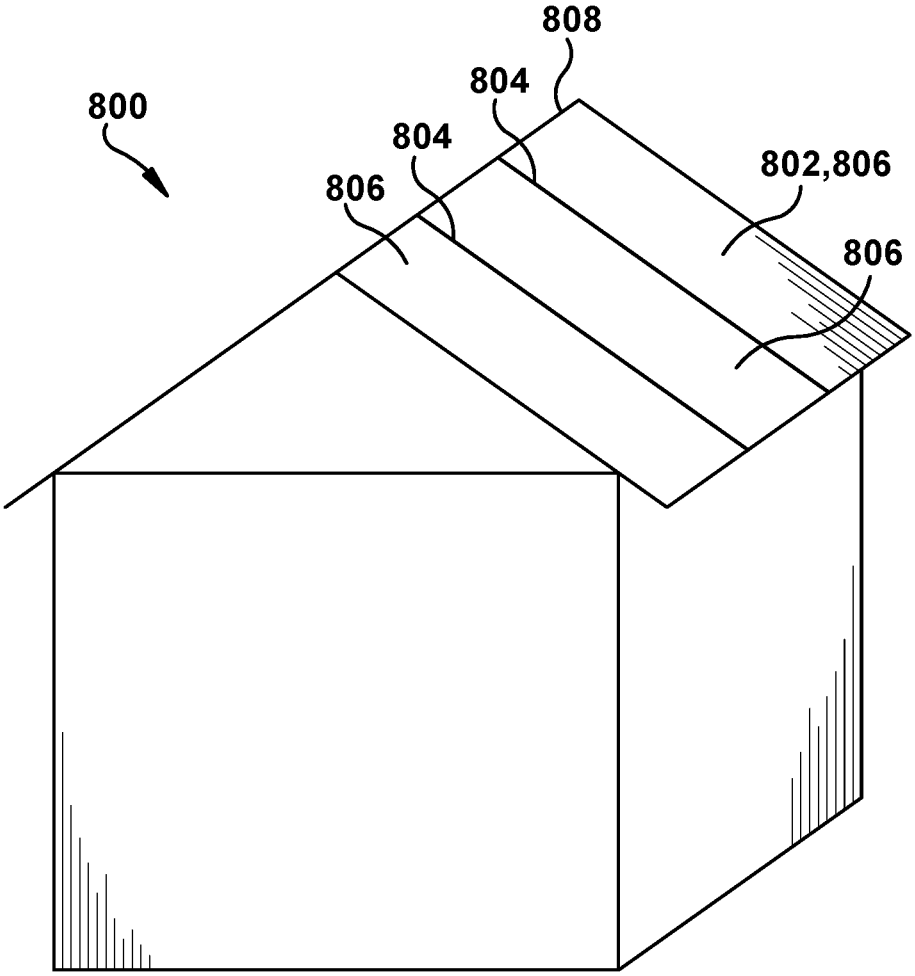
FIG. 8 is a perspective view of a building having vertical seams with an exemplary underlayment.

FIG. 8 is a perspective view of a building 800 having vertical seams 804 on the roof 802 with an exemplary underlayment 806 installed between each of the seams 804. In one embodiment, in order to attach the underlayment 806 to the vertical seams 804, a double hook seam product (not shown) may be used to prevent the underlayment 806 from moving toward the ridge 808 of the roof and down the vertical seam 804. The double hook seam product may include any of the hook fasteners described in the present application, but with at least two hook fasteners preventing movement in two different directions. In other embodiments, other attachment mechanisms, such as, for example, tape, adhesive, such as pressure sensitive adhesive, heat activated adhesive, asphalt based adhesive, or the like may be used to attach the underlayment 806 to vertical seams 804.

The present application discloses a roof covering that provides several advantages. For example, in certain embodiments, the roof covering described in the present application will only have to be made long enough to cover the roof from the ridge to the eaves in both directions, which means that the roof covering can be made very wide. In this example, rolls of the roof covering can be manufactured in a factory and then sent to customers, and the customers could have scrolling equipment that lets a roofing contractor order only enough product for their job. This gives customers a value-added service by eliminating time and product waste on the job site.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof.

Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A roofing system comprising:

a first group of hook fasteners configured to be attached to at least one sheathing panel on a first sloped plane of a roof;

a second group of hook fasteners configured to be attached to at least one sheathing panel on a second sloped plane of the roof;

a single piece of flexible roof covering having a bottom surface, wherein the roof covering is configured to extend from an eave of the first sloped roof plane to an eave of the second sloped roof plane;

wherein the bottom surface of the roof covering comprises a plurality of loop fasteners configured to engage with at least one of the first group of hook fasteners and the second group of hook fasteners;

wherein when the plurality of loop fasteners of the roof covering are engaged with the first group of hook fasteners, the roof covering directly contacts the at least one sheathing panel of the first sloped plane of the roof and is resisted from moving in a first direction and not resisted from moving in a second direction that is opposite the first direction; and wherein when the plurality of loop fasteners of the roof covering are engaged with the second group of hook fasteners, the roof covering directly contacts the at least one sheathing panel of the second sloped plane of the roof and is resisted from moving in the second direction and not resisted from moving in the first direction.

2. The roofing system of claim 1 wherein the roof covering further comprises at least one opening configured to align with a ridge of the roof when the roof covering is installed on the roof.

3. The roofing system of claim 2 wherein the roofing system further comprises a tensioner configured to attach to the roof covering, wherein the tensioner biases the roof covering in an up slope direction when the tensioner is attached to the roof covering and when the roof covering is installed on the roof.

4. The roofing system of claim 3 wherein the tensioner comprises a first end, a second end, and an elastic member.

5. A roof assembly comprising:

a first sloped roof plane having an eave, an upper end, and at least one sheathing panel disposed between the eave and the upper end;

a second sloped roof plane transverse to the first sloped roof plane, the second sloped roof plane having an eave, an upper end, and at least one sheathing panel disposed between the eave and the upper end, wherein the upper end of the first sloped roof plane and the upper end of the second sloped roof plane form a ridge;

a first group of hook fasteners attached to a top surface of the at least one sheathing panel of the first sloped roof plane, wherein each hook fastener of the first group of hook fasteners is facing toward the eave of the first sloped roof plane;

a second group of hook fasteners attached to a top surface of the at least one sheathing panel of the second sloped roof plane, wherein each hook fastener of the second group of hook fasteners is facing toward the eave of the second sloped roof plane;

a roof covering extending from the eave of the first sloped roof plane to the eave of the second sloped roof plane, the roof covering having a bottom surface including a group of loop fasteners;

wherein the first group of hook fasteners and the group of loop fasteners cooperate to resist movement of the roof covering relative to the first roof sloped plane in an up slope direction while allowing movement of the roof covering relative to the first sloped roof plane in a down slope direction; and wherein the second group of hook fasteners and the group of loop fasteners cooperate to resist movement of the roof covering relative to the second sloped roof plane in an up slope direction while allowing movement of the roof covering relative to the second sloped roof plane in a down slope direction.

6. The roof assembly of claim 5 wherein the first group of hook fasteners and the second group of hook fasteners comprise unidirectional hook fasteners.

7. The roof assembly of claim 5 wherein the first group of hook fasteners and the second group of hook fasteners are each arranged in at least one of horizontal and vertical strips.

8. The roof assembly of claim 5 wherein the roof covering further comprises a series of openings configured to align with the ridge.

9. The roof assembly of claim 8 further comprising a tensioner attached to the roof covering, wherein the tensioner biases the roof covering in the up slope direction.

10. The roof assembly of claim 9 wherein the tensioner provides a force of less than 25 lb/ft on the roof covering in the up slope direction.

11. The roof assembly of claim 9 wherein the tensioner comprises a first end, a second end;

wherein the first end is attached to a part of the roof covering that extends over the first sloped roof plane;

wherein the first end is adjacent to the at least one opening;

wherein the second end is attached to a part of the roof covering that extends over the second sloped roof plane;

wherein the second end is adjacent to the at least one opening;

wherein the tensioner biases the first end and the second end toward each other.

12. The roof assembly of claim 8 wherein the roof covering is a unitary sheet.

13. The roof assembly of claim 5, wherein the at least one sheathing panel of both the first sloped roof plane and the second sloped roof plane are made of a wood-based material, and wherein the roof covering is a single piece of flexible material that directly contacts the at least one sheathing panel of both the first sloped roof plane and the second sloped roof plane.

14. A method of installing a roof covering on a roof having a first sloped roof plane, a second sloped roof plane transverse to the first sloped roof plane, and a ridge area connecting the first sloped roof plane to the second sloped roof plane, the method comprising:

covering a portion of a top surface of at least one sheathing panel of the first sloped roof plane with a first group of hook fasteners;

covering a portion of a top surface of at least one sheathing panel of the second sloped roof plane with a second group of hook fasteners;

covering the first sloped roof plane and the second slope roof plane with a single piece of flexible roof covering having loop fasteners such that the roof covering directly contacts the at least one sheathing panel of the first sloped plane and the at least one sheathing panel of the second sloped plane;

providing a force in the down slope direction to the portion of the roof covering on the first sloped roof plane to pull the portion of the roof covering on the first sloped roof plane taut; and providing a force in the down slope direction to the portion of the roof covering on the second sloped roof plane to pull the portion of the roof covering on the second sloped roof plane taut.

15. The method of claim 14 further comprising providing the roof covering in a scroll configuration and placing the scrolled roof covering at the ridge area.

16. The method of claim 15 wherein covering the first sloped roof plane and the second slope roof plane with the roof covering comprises unrolling the roof covering down the first sloped roof plane and down the second sloped roof plane.

17. The method of claim 14 further comprising forming at least one opening in the roof covering along the ridge area.

18. The method of claim 17 further comprising attaching a tensioner to the roof covering that provides a force to the roof covering in the up slope direction, wherein the tensioner is attached to the roof covering at a location adjacent to the at least one opening.

19. The method of claim 18 wherein the force provided to the roof covering by the tensioner is less than 25 lb/ft.

20. The method of claim 14, wherein the at least one sheathing panel of both the first sloped roof plane and the second sloped roof plane are made of a wood-based material.

* * * * *